United States Patent [19]

Hertzler

[11] 4,351,265

[45] Sep. 28, 1982

[54] SYSTEM FOR APPLYING A LIQUID TO THE STUDS OF A COLOR KINESCOPE FACEPLATE PANEL

[75] Inventor: Merle E. Hertzler, Elverson, Pa.

[73] Assignee: RCA Corporation, New York, N.Y.

[21] Appl. No.: 235,973

[22] Filed: Feb. 19, 1981

[51] Int. Cl.[3] ..... B05C 1/02; B05C 7/06

[52] U.S. Cl. ..... 118/211; 118/215; 118/222; 118/225; 118/243; 118/500

[58] Field of Search ..... 118/211, 214, 215, 225, 118/243, 56, 503, 500, 222

[56] References Cited

U.S. PATENT DOCUMENTS

| | | | |
|---|---|---|---|
| 1,194,244 | 8/1916 | Schwartz | 118/243 X |
| 2,755,768 | 7/1956 | Olson | 118/243 X |
| 2,902,973 | 9/1959 | Weingarten et al. | 118/56 |
| 3,108,023 | 10/1963 | Griesemer et al. | 118/215 |
| 3,473,942 | 10/1969 | Magill et al. . | |

FOREIGN PATENT DOCUMENTS

| | | | |
|---|---|---|---|
| 52-9370 | 1/1977 | Japan | 118/215 |

*Primary Examiner*—John P. McIntosh

*Attorney, Agent, or Firm*—Eugene M. Whitacre; Dennis H. Irlbeck; Lester L. Hallacher

[57] ABSTRACT

A system for applying conductive paint to the studs of a kinescope faceplate includes oppositely threaded, coaxially aligned screws. Each screw drives a paint reservoir and a paint applicator. Simultaneous rotation of the screws in the same direction causes the applicators and reservoirs to move along the screws in opposite directions. The screws, and the components coupled to them, are movable perpendicular to the longitudinal axis of the screws by back-to-back coaxially aligned jacks.

10 Claims, 4 Drawing Figures

SYSTEM FOR APPLYING A LIQUID TO THE STUDS OF A COLOR KINESCOPE FACEPLATE PANEL

BACKGROUND OF THE INVENTION

This invention relates generally to the manufacture of kinescopes and particularly to a system for applying conductive paint to the studs of a color kinescope faceplate panel.

The screen on the inside surface of a kinescope faceplate panel is made conductive by the application of an aluminized coating. During the operation of the kinescope, a high positive voltage is placed upon the conductive coating to accelerate the electron beams toward the screen. In color kinescopes a shadow mask is supported near the screen by studs which are imbedded in the sides of the faceplate panel. The shadow mask is operated at the same potential as the aluminized coating. For this reason it is necessary to electrically connect the studs and the aluminized coating. Typically, this electrical connection is made by a strip of conductive paint which extends between the studs and the aluminized screen. In the prior art, this conductive strip is applied by hand.

The instant invention is directed to a system for automatically applying the conductive paint to the studs in the sidewalls of a color kinescope faceplate.

SUMMARY OF THE INVENTION

A system for automatically applying a liquid to at least one area on the inside of a kinescope faceplate includes a mounting member which is movable with respect to the faceplate. A reservoir of the liquid is supported by and is movable with the mounting member. A liquid applicator is also supported by the mounting member in the proximity of the reservoir and also is movable with the mounting member. A first means is provided for moving the mounting member parallel to one axis of the faceplate. Another means is provided for moving the mounting member and the first moving means perpendicular to the same axis.

DETAILED DESCRIPTION OF THE PREFERRED EMBODIMENT

Figure 1:
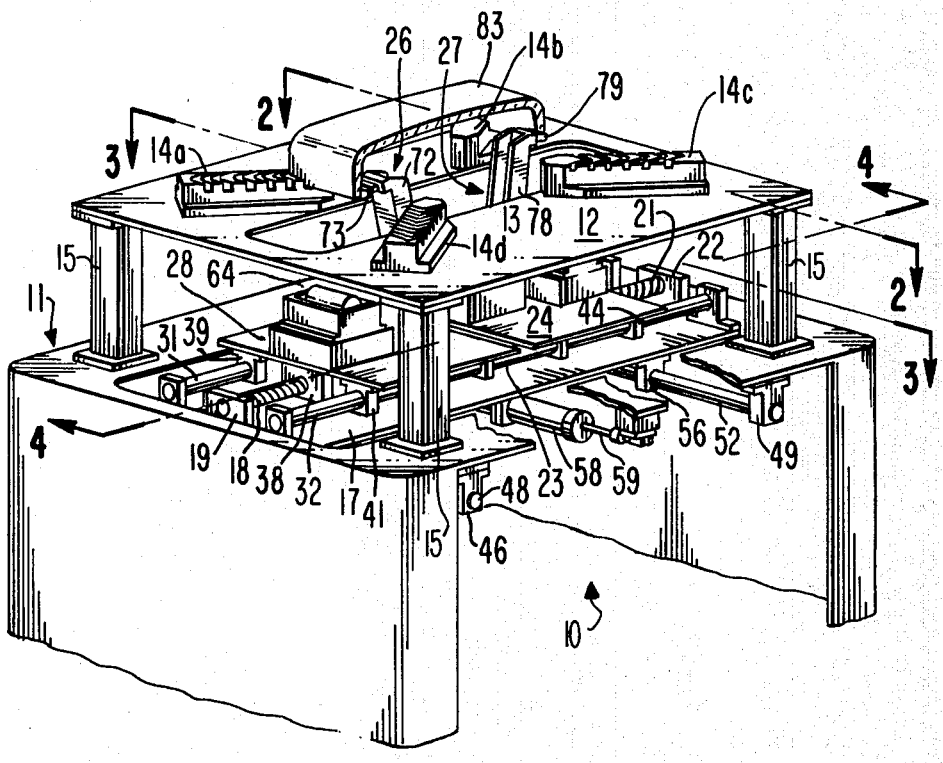
FIG. 1 is a perspective view of a preferred embodiment of the novel system.
Figure 2:
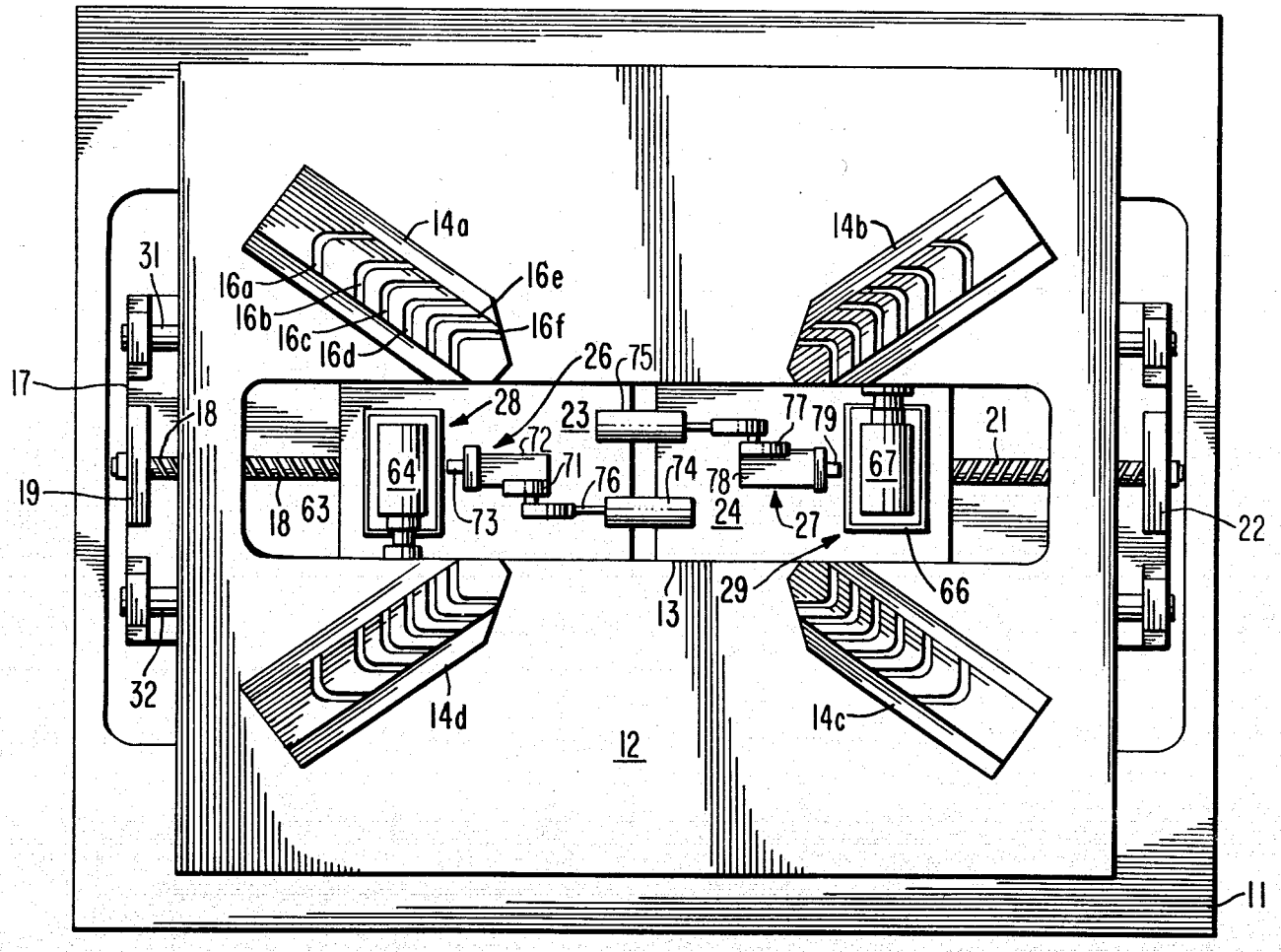
FIG. 2 is a top view taken along line 2—2 of FIG. 1.

A preferred embodiment of the novel system 10, shown in FIG. 1, includes a stationary base plate 11. A support plate 12 having a slot 13 centrally positioned therein is attached to the base plate 11 by four vertically oriented legs 15. Four faceplate positioning and holding members 14*a*, 14*b*, 14*c* and 14*d* are arranged around the slot 13. As shown in FIG. 2, each of the positioning members 14*a* through 14*d* includes a plurality of grooves 16*a* through 16*f* spaced along the longitudinal axis. The grooves 16*a* through 16*f* are configured to be congruent to the corners of a kinescope faceplate. Accordingly, the grooves in each of the positioning members are spaced so that a plurality of different sizes of faceplates can be held without the need for adjustable components.

A movable support plate 17 is arranged beneath the stationary support plate 12 and a bearing 19, which rotatably supports a right-hand threaded screw 18, is affixed to one end of the plate 17. A similar bearing 22, which rotatably supports a left-hand threaded screw 21, is affixed to the other end of the plate 17. The screws 18 and 21 are coaxially aligned and are arranged to simultaneously rotate in the same direction in a manner described hereinafter. Rotatably coupled to the right-hand threaded screw 18 is a mounting member 23 and a similar mounting member 24 is rotatably coupled to the left-hand threaded screw 21. The screws 18 and 21 are oppositely threaded and therefore the mounting members 23 and 24 move away from and toward one another when the screws 18 and 21 are simultaneously rotated in the same direction. A first liquid applicator 26 and a first liquid reservoir 28 are coupled to the mounting member 23 to move simultaneously therewith. Similarly, a second liquid applicator 27 and a second liquid reservoir 29 are arranged to move along with the mounting member 24. The mounting members 23 and 24 are held in an orientation which is substantially parallel to the plane of the support plate 12 by two rods 31 and 32 in a manner described in detail hereinafter.

Figure 3:
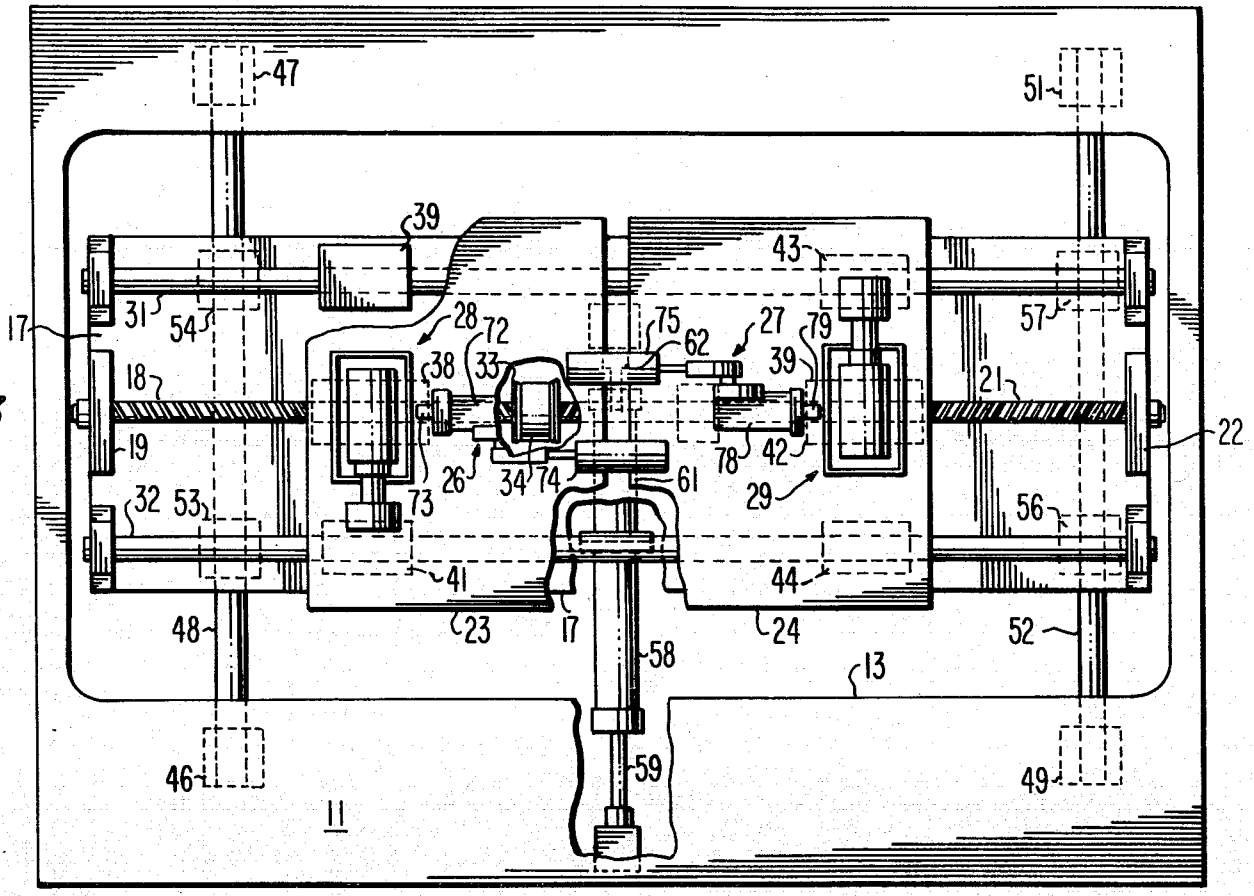
FIG. 3 is a top view, partially broken away, taken along line 3—3 of FIG. 1.
Figure 4:
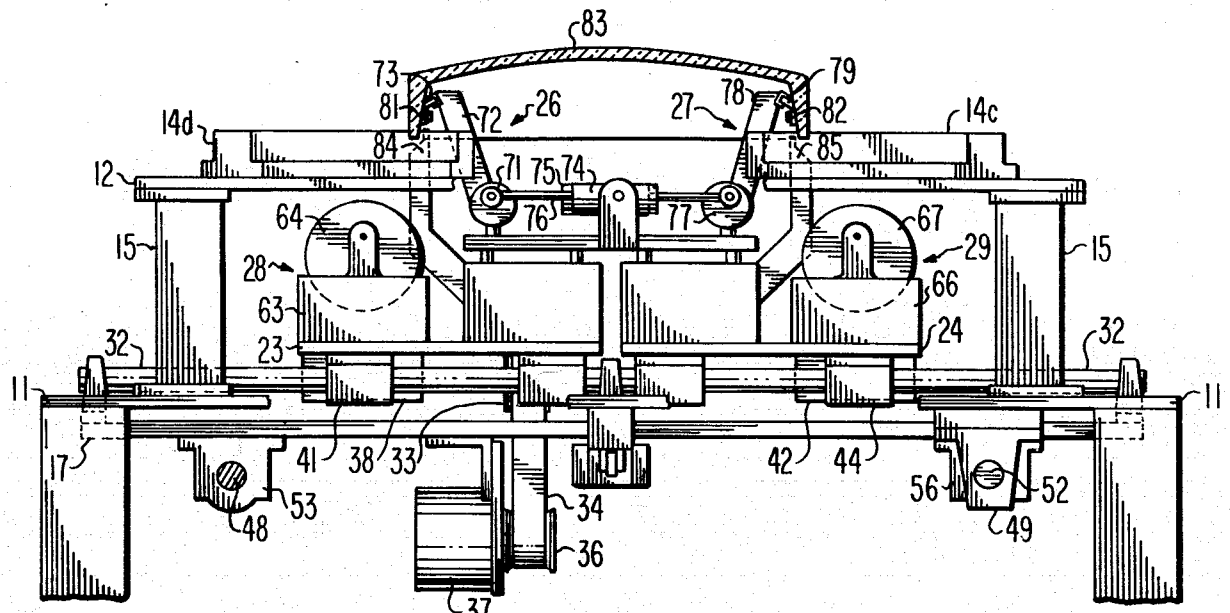
FIG. 4 is a side view taken along line 4—4 of FIG. 1.

The screws 18 and 21 are joined by a coupler 33, shown in FIGS. 3 and 4 which also serves as a pulley over which a belt 34 passes. The belt also passes over another pulley 36 (FIG. 4) which is driven by an electric or hydraulic motor 37. A drive nut 38 which is permanently affixed to the mounting member 23 is threaded onto the screw 18. The rods 31 and 32 respectively pass through slides 39 and 41 which also are affixed to the mounting plate 23. Accordingly, as the screw 18 is rotated, the threaded drive nut 38 is threaded along the screw 18 and the mounting member 23 is moved along the screw parallel to the longitudinal axis of the slot 13. The mounting member 23 is held substantially parallel to the plane of the slot 13 by the slides 39 and 41 sliding along the rods 31 and 32 respectively. The screw 21 passes through another drive nut 42 to which the mounting member 24 is permanently affixed. The parallel orientation of the mounting member 24 also is maintained by the slides 43 and 44, and the rods 31 and 33 respectively.

Mounting brackets 46 and 47 are stationarily affixed to the bottom surface of the baseplate 11. Extending between the brackets 46 and 47 is a rod 48 which transversely spans the slot 13 in the support plate 12. A similar pair of mounting brackets 49 and 51 is also arranged on the bottom surface of the plate 11 and supports a rod 52 which parallels the rod 48 and is also transverse to the slot 13. The rod 48 slidably receives the slides 53 and 54 which are affixed to the support plate 17. Similarly, the shaft 52 slidably receives the slides 56 and 57 which also are permanently affixed to the support plate 17. Accordingly, the support plate 17 and the mounting brackets 23 and 24 which are affixed thereto are free to move transversely across the slot 13. A cylinder actuator 58 is coupled to the bottom side of the stationary baseplate 11 by a movable shaft 59. Another cylinder actuator 61 is longitudinally aligned with, and affixed to, the cylinder 58. The shaft 62 of the cylinder 61 is coupled to the underside of the support plate 17. Accordingly, actuation of either of the cylinders 58 or 61 causes the support plate 17 to move transversely relative to the slot 13 to thereby position the applicators 26 and 27 at any desired location within the slot. However, because of the back-to-back and coaxial arrangement of the cylinders 58 and 61, three discrete positions are obtainable by having both cylinders closed, one open and one closed, or both open.

As shown in FIG. 4, the reservoir 28 includes a liquid container 63 and a rotatable drum 64. The drum 64 is arranged so that a portion of the drum surface rotates through the liquid within the container 63. The other reservoir 29 is similarly comprised of a fluid container 66 and a rotatable drum 67. Affixed to the mounting member 23 along with the fluid reservoir 28 is the liquid applicator 26. Because the reservoir 28 and the applicator 26 are affixed to the mounting member 23, they are stationary with respect to one another and simultaneously movable longitudinally with respect to the slot 13 of the support plate 12 when the screw 18 rotates. The other liquid applicator 27 is substantially identical to the applicator 26 and is arranged to move along with the reservoir 29 when the mounting member 24 moves in response to the rotation of the screw 21.

The applicator 26 includes a rotatable disc 71. One end of an arm 72 is affixed to the disc 71 and the free end of the arm 72 carries a liquid permeable pad 73. A small cylinder 74 is coupled to the disc 71 by a shaft 76. The coupling of the shaft 76 to the disc 71 is displaced from the center of the disc 71 so that linear motion of the shaft 76 is translated into rotational motion of the arm 72. The applicator 27 is similarly constructed to include a disc 77, a cylinder 75 and an arm 78 which carries a liquid permeable pad 79.

The arms 72 and 78 have three primary positions, the first of which is substantially vertical. In the second position, shown in FIG. 4, the pads 73 and 79 respectively contact the studs 81 and 82 of a faceplate 83 to apply the conductive paint to the studs. In the third position, the pads 73 and 79 respectively contact the drums 64 and 67 and a fresh supply of conductive paint is received by the pads.

In operation the faceplate 83 is placed upon the positioning and the holding members 14*a* through 14*d* and, depending upon the size of the faceplate, are held in position by the grooves 16*a* through 16*f*. After the faceplate is in place, the motor 37 is energized resulting in rotation of the screws 18 and 21. The two mounting plates 23 and 24 and thus the liquid reservoirs 28 and 29 and the applicators 26 and 27 travel away from one another toward the studs 81 and 82 of the faceplate 83. When the applicators have arrived in the close proximity of the studs 81 and 82 so that a small angular rotation of the arms 72 and 78 will bring the pads 73 and 79 into engagement with the studs 81, and 82 the motor 37 is stopped. The desired travel can be indicated by the engagement of two switches 84 and 85, shown in FIG. 4, which respectively are associated with the applicators 26 and 27, with the inside of the faceplate sidewalls. The microswitches 84 and 85 can be the dual contact types wherein one set of contacts opens to stop the motor 37, while the other set of contacts closes to energize the cylinders 74 and 75. Upon the energization of the cylinders 74 and 75, the arms 72 and 78 are rotated to the second angular disposition and the pads 73 and 79 engage the studs 81 and 82 respectively, and the conductive fluid is applied to the studs. After the conductive paint is applied to the studs, the arms 72 and 78 are returned to the vertical position. The direction of rotation of the motor 37 is thus reversed and the applicators 26 and 27 move toward the neutral position near the longitudinal center of the slot 13. During the return motion the arms 72 and 78 are rotated downwardly through the slot 13 until the pads 73 and 79 engage the drums 64 and 67, respectively, to receive a fresh supply of the conductive fluid. The faceplate 83 can be removed and replaced with another, either manually or by automatic means, during the return travel. The switching and other circuitry utilized to control the various operations is within the purview of those skilled in the art and forms no part of the invention and therefore is not fully disclosed herein. Additionally, if desired, those skilled in the art can use a programmable computer to control the various operations.

What is claimed is:

1. A system for automatically applying a liquid to at least one selected area on the inside surface of kinescope faceplates of various sizes comprising:

means for stationarily holding various sizes of kinescope faceplates;

at least one mounting member arranged for movement with respect to and parallel to the plane of said faceplate holding means, said mounting member including a reservoir of said liquid and a liquid applicator arranged in the proximity of said reservoir;

first means for moving said mounting member relative to said holding means and parallel to one axis of said faceplate; and second means for moving said mounting member and said first means for moving perpendicular to said one axis.

2. The system of claim 1 wherein there are two of said mounting members arranged to move simultaneously in opposite directions parallel to said axis so that said liquid is applied to facing sides of said faceplate.

3. The system of claim 2 wherein said first means for moving includes a right-hand threaded screw operatively associated with the first of said mounting members, a left-hand threaded screw operatively associated with the second of said mounting members, and means for simultaneously rotating said right and left hand screws in the same direction so that said mounting members move along said screws in opposite directions.

4. The system of claim 3 wherein said second means for moving includes a plurality of longitudinally aligned, separately actuated cylinders.

5. The system of claim 4 wherein said liquid applicators include a rotatable member, an arm having one end fixed to said rotatable member and perpendicular to the axis of rotation of said member, a liquid permeable pad fixed to the other end of said arm, and means for rotating said rotatable member through a first angular displacement and in a first direction so that said pad contacts said faceplate to apply a dab of said liquid to said faceplate and through a second angular displacement in said first direction so that said pad contacts said reservoir and picks up said liquid and through a third angular displacement opposite in direction to said first direction to return said arm and said pad to a neutral position.

6. the system of claim 5 wherein said reservoir includes a liquid container and a drum arranged to rotate with respect to said container and positioned so that a portion of said drum moves through said liquid.

7. The system of claim 4 wherein said reservoir includes a liquid container and a drum arranged to rotate with respect to said container and positioned so that a portion of said drum moves through said liquid.

8. The system of claim 4 or 5 or 6 further including a support plate having a slot arranged so that said liquid applicators move longitudinally along said slot with said arms passing through said slot, and faceplate positioning means affixed to said support plate and arranged to receive said faceplate to position and orientate said faceplate over said slot whereby said pads contact the inside surface of the sides of said faceplate when said arms are rotated through said first angular displacement.

9. The system of claim 8 further including a stationary base, and wherein said support plate is affixed to said base, one end of said cylinders being coupled to said base and the other end of said cylinders being coupled to said mounting members whereby actuation of said cylinders moves said applicators transversely of said slot.

10. The system of claim 9 wherein said faceplate positioning means are arranged to receive the corners of said faceplate, and wherein said positioning means contain a plurality of grooves spaced at selected intervals and configured congruently to the corners of said faceplate so that faceplates of various sizes are supportable over said slot.

* * * * *